United States Patent [19]

Van Winkle

[11] Patent Number: 4,943,031

[45] Date of Patent: Jul. 24, 1990

[54] BLOWOUT PREVENTER

[75] Inventor: Denzal W. Van Winkle, Houston, Tex.

[73] Assignee: Drexel Oilfield Services, Inc., Conroe, Tex.

[21] Appl. No.: 393,901

[22] Filed: Aug. 17, 1989

[51] Int. Cl.[5] ..... E21B 33/06

[52] U.S. Cl. ..... 251/1.3; 137/630.15

[58] Field of Search ..... 137/630.12, 630.15; 251/1.3, 1.1

[56] References Cited

U.S. PATENT DOCUMENTS

| | | | |
|---|---|---|---|
| 3,036,807 | 5/1962 | Lucky et al. | 251/1.3 |
| 3,744,749 | 7/1973 | LeRouax | 251/1.3 |
| 3,871,613 | 3/1975 | LeRouax | 251/1.3 |
| 3,918,478 | 11/1975 | LeRouax | 251/1.3 |
| 4,253,638 | 3/1981 | Troxell, Jr. | 251/1.3 |
| 4,467,996 | 8/1984 | Baugh | 251/1.3 |
| 4,488,703 | 12/1984 | Jones | 251/1.3 |
| 4,508,313 | 4/1985 | Jones | 251/1.3 |
| 4,582,293 | 4/1986 | Jones | 251/1.1 |
| 4,589,625 | 5/1986 | Jones | 251/1.3 |
| 4,638,972 | 1/1987 | Jones et al. | 251/1.3 |
| 4,655,431 | 4/1987 | Helfer et al. | 251/1.3 |

FOREIGN PATENT DOCUMENTS

| | | | |
|---|---|---|---|
| 553249 | 6/1932 | Fed. Rep. of Germany | 137/630.12 |

*Primary Examiner*—John Rivell
*Assistant Examiner*—L. R. Leo
*Attorney, Agent, or Firm*—Jack W. Hayden

[57] ABSTRACT

A blowout preventer having a housing with a bore therethrough and chambers which intersect with rams reciprocable within the chambers between a first position for opening the bore and a second position for closing the bore to divide the bore into zones above and below the rams includes a rod connected to each of the rams and extending longitudinally within each of the chambers and offset relative to the longitudinal axis of the chambers to guide as well as move each of the rams inwardly toward the bore to close the bore and to withdraw each ram from the bore by moving the rams outwardly from the bore in the chamber. A valve is mounted in the end of the rod that is connected with at least one ram to control communication through a passage in the ram wherein the passage has a first passage end that communicates with the zone above the ram and a second passage end that communicates with the chamber adjacent the end of the rod connected to the ram. The valve is movable relative to the rod in which it is positioned to assure that the second passage end will remain engaged thereby should the ram move laterally relative to the chamber.

5 Claims, 2 Drawing Sheets

BLOWOUT PREVENTER

SUMMARY OF THE INVENTION

The use of blowout preventers in drilling, completion workover and production of oil and gas wells is well known. Such blowout preventers generally include a housing with a bore extending therethrough. Opposed chambers extend laterally of the bore in the housing and communicate with the bore. Rams are positioned in the chambers and are connected with a rod that is supported for moving the rams inwardly into the bore to close it off to divide it into a zone above the rams and a bore below the rams and to retract outwardly from the bore to open the bore. Also, various types of rams may be employed such as those which engage circumferentially around a pipe or tubular member for sealing therewith, while others are provided with cutting surfaces for shearing tubular members or cables which extend through the bore of the blowout preventer.

In prior art blowout preventers, the rod which is connected with the ram for effecting movement thereof into and out of the bore, extends axially and longitudinally of the chamber. In some instances the rod extends sealably through the housing and includes a threaded surface thereon that enables the rod to be rotated for effecting longitudinal movement thereof to move the ram into or out of the bore in the housing. The ram and its rod may be pressure actuated by fluid pressure into the chamber which moves the ram into the bore in a desired manner.

When the blowout preventer rams are positioned within the bore, the higher pressure in the well bore beneath the rams is employed to assist in maintaining the rams closed by conducting such pressure to act on the back surface of the rams. Thus, when it is desired to withdraw the rams from the bore, it is desirable to relieve this pressure and to balance the pressure in the bore above the rams with the pressure in the bore below the ram.

U.S. Pat. No. 4,638,972 issued on Jan. 22, 1987 illustrates one arrangement for accomplishing this result wherein a passage is provided in the ram which communicates with the zone above the rams and also communicates with the chamber in which the ram is positioned, such passage terminating adjacent the end of the rod with which the ram is connected. Such patent also illustrates an elastomer seal on the end of the rod in an attempt to effect a seal between the end of the rod and the passage end in the ram adjacent the end of the rod.

However, in actual operation of a blowout preventer, the rams may move laterally relative to the chamber in which they are positioned due to the substantial pressure in the zone beneath the rams which tends to move the rams upwardly when they are in closed position to separate the bore into two zones as above stated. It can be appreciated that in such event, substantial problems are encountered in maintaining a seal, particularly of a type as illustrated in U.S. Pat. No. 4,638,972 due to the fact that the end surface of the rod adjacent the surface of the ram with which it is connected will become misaligned or cocked at an angle relative to the ram providing a gap which may enable pressure from beneath the ram to escape into the zone above the ram. This may produce deleterious and undesirable results with the blowout preventer.

Also, prior blowout preventers have included an arrangement to guide and maintain the rams properly aligned to prevent the rams from rotating about their respective axes. Such arrangement has heretofore taken the form of providing rams which are elliptical, or non-circular in cross-section, or providing a key either in the ram or in the housing chamber in which the ram is mounted that cooperates with a corresponding opposed keyway in either the ram or the chamber housing within the chamber so as to guide the rams as they move inwardly to close off the bore, or as they are withdrawn from the bore back into the housing chamber.

It can be appreciated that the key and keyway arrangement increases the cost of manufacture and assembly time. Also, the key and keyway arrangement may become clogged or damaged during use thus necessitating repair and this it is less costly and more desirable to employ circular rather than non-circular rams.

The present invention overcomes the above and other problems attendant with present blowout preventers in that it provides an arrangement for guiding the rams and prevents their rotation without the necessity of employing a key or keyway or employing non-circular rams.

Also, the present invention provides a valve assembly associated with the rod to assure that the valve and the end of the passage in the ram that is adjacent the rod will remain engaged even though the ram and adjacent rod end may become misaligned due to well bore pressure in the zone beneath the ram and acting thereon.

One of the objects of the present invention is to provide apparatus for use with a blowout preventer having a housing with a bore therethrough and opposed chambers which intersect the bore with rams reciprocable within the chambers between a first position for opening the bore and second position for closing the bore to divide the bore into zones above and below the rams, the apparatus including a rod connected to each of the rams and extending longitudinally within each of the chambers and offset relative to the longitudinal axis of the chambers to act as a guide to keep the ram from rotating about its axis as it is moved into the bore of the blowout preventer and as the ram is withdrawn from the bore back into the housing chamber, and means for supporting the rods for reciprocation in their respective chambers between the first and second ram positions.

Yet a further object of the present invention is to provide apparatus for use with a blowout preventer having a housing with a bore therethrough and chambers which intersect the bore and rams reciprocable within the chambers between a first position and a second position for closing the bore to divide the bore into zones above and below the rams, the apparatus including a rod connected to each of the rams and extending longitudinally within each of the chambers, means for supporting each rod for reciprocation within its respective chamber, passage means end having at least one ram, such passage having a first passage end for communicating with the zone above the ram and a second passage end for communicating with the chamber adjacent the end of the rod connected to the ram, means for closing off communication through the passage from the zone below the ram to the zone above the ram, such means including valve means, such as by way of example only check valve means supported adjacent the end of said rod for longitudinal and/or lateral movement relative to the rod for closing off the passage end which communicates with the chamber adjacent the end of the rod. A gate valve, spool valve or other suitable closure may be employed to accomplish the results of the present invention.

Yet a further object of the present invention is to provide apparatus for use with a blowout preventer having a housing with a bore therethrough and chambers which intersect the bore and rams reciprocable within the chambers between a first position and a second position for closing the bore to divide the bore into zones above and below the rams, the apparatus including a rod connected to each of the rams and extending longitudinally within each of the chambers, means for supporting each rod for reciprocation within its respective chamber, passage means end having at least one ram, such passage having a first passage end for communicating with the zone above the ram and a second passage end for communicating with the chamber adjacent the end of the rod connected to the ram, means for closing off communication through the passage from the zone below the ram to the zone above the ram, such means including valve means supported adjacent the end of said rod for relative longitudinal movement between said valve means and said rod for closing off the passage end which communicates with the chamber adjacent the end of the rod and means to accommodate relative lateral movement of the check valve means between said valve means and said rod and ram in response to movement laterally of the ram in the chamber due to pressure in the zone either above or below the ram.

Yet a further object of the present invention is to provide apparatus for use with a blowout preventer having a housing with a bore therethrough and chambers which intersect the bore and rams reciprocable within the chambers between a first position and a second position for closing the bore to divide the bore into zones above and below the rams, the apparatus including a rod connected to each of the rams and extending longitudinally within each of the chambers, means for supporting each rod for reciprocation within its respective chamber, passage means end having at least one ram, such passage having a first passage end for communicating with the zone above the ram and a second passage end for communicating with the chamber adjacent the end of the rod connected to the ram, means for closing off communication through the passage from the zone below the ram to the zone above the ram, such means including valve means supported adjacent the end of said rod for relative longitudinal movement between said valve means and said rod for closing off the passage end which communicates with the chamber adjacent the end of the rod.

Yet a further object of the present invention is to provide apparatus for use with a blowout preventer having a housing with a bore therethrough and chambers which intersect the bore and rams reciprocable within the chambers between a first position and a second position for closing the bore to divide the bore into zones above and below the rams, the apparatus including a rod connected to each of the rams and extending longitudinally within each of the chambers, means for supporting each rod for reciprocation within its respective chamber, passage means end having at least one ram, such passage having a first passage end for communicating with the zone above the ram and a second passage end for communicating with the chamber adjacent the end of the rod connected to the ram, means for closing off communication through the passage from the zone below the ram to the zone above the ram, such means including valve means supported adjacent the end of said rod for relative lateral movement between said valve means and said rod for closing off the passage end which communicates with the chamber adjacent the end of the rod.

DESCRIPTION OF THE PREFERRED EMBODIMENTS

Figure 1:
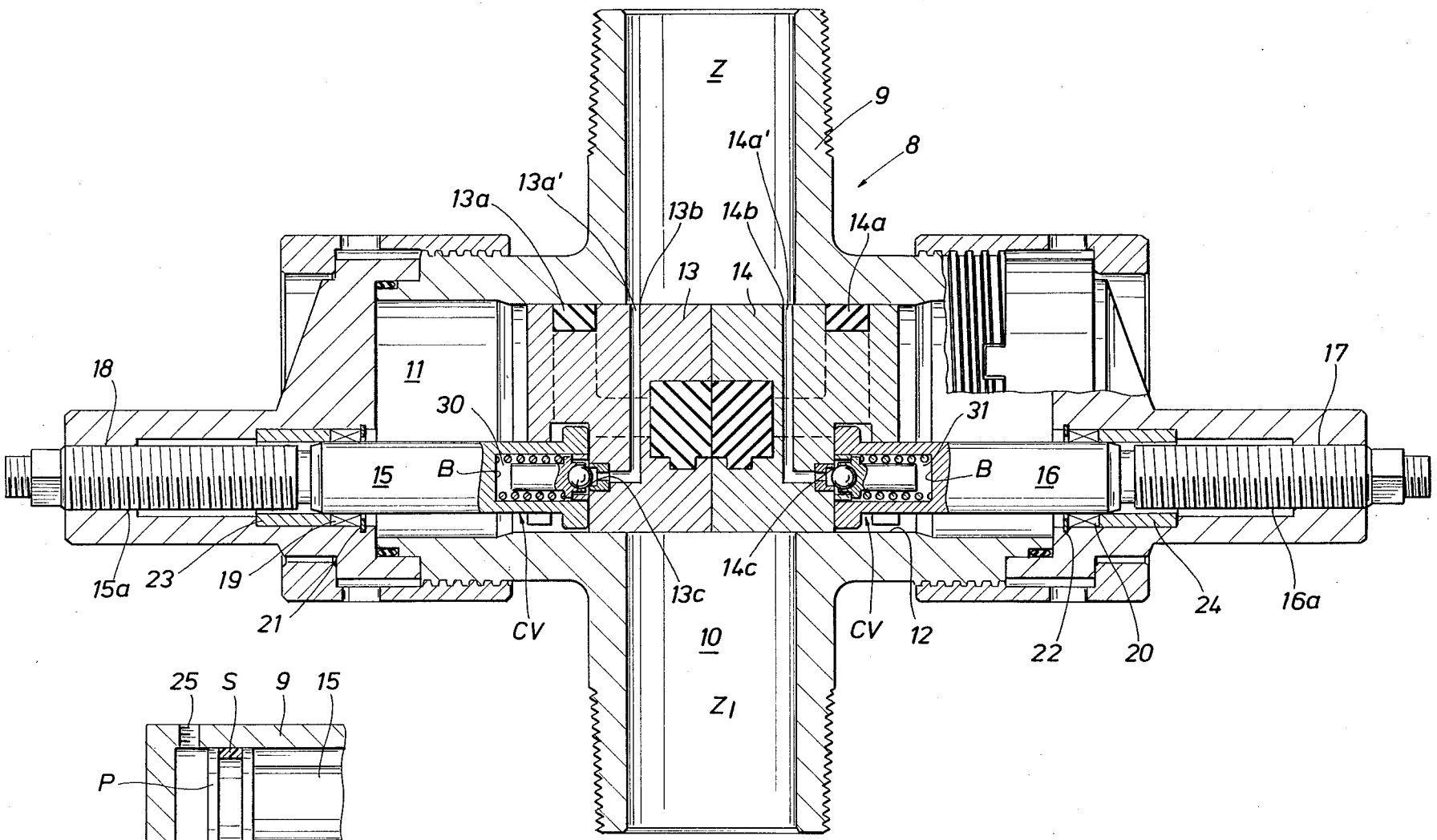
FIG. 1 is a sectional view, partly in elevation, illustrating a blowout preventer housing with a bore therethrough and chambers extending laterally of the housing to intersect the bore with rams therein and rods connected with each of the rams and supported for reciprocation in each chamber. The rods are provided with check valve means and the rods are offset relative to the longitudinal axis of the chambers.

Attention is directed to FIG. 1 of the drawings wherein a blowout preventer is represented generally by the numeral 8 and is shown as including a housing 9 having a bore 10 extending therethrough. The housing includes laterally and longitudinally extending chambers 11 and 12 which communicate at their inner ends with the bore as shown and receive the rams 13 and 14 within the chambers 11 and 12 respectively. In the present invention the chambers 11 and 12 are cylindrical as are the rams 13 and 14.

The rams 13 and 14 are each connected with a longitudinally extending rod 15 and 16 respectively which are offset, or eccentric, relative to the longitudinal axis of the longitudinally extending chambers 11 and 12 as shown in FIG. 1 of the drawings. This arrangement serves as a guide for the rams 13 and 14 as they reciprocate within their respective chambers to the closed position shown in FIG. 1 and to a retracted position within their respective chambers to open the bore 10 of the blowout preventer. Also, such arrangement eliminates the cost of providing a key and keyway arrangement between the ram and its respective chamber wall to inhibit rotation of the rams, and also eliminates the expense of repair and maintenance of the key and keyway due to fouling by well bore fluids and the like. Such arrangement has the added advantage that it enables the rams 13 and 14 to assume a cylindrical configuration rather than a non-cylindrical configuration such as elliptical or the like.

It should also be noted that each ram 13 and 14 is provided with a suitable seal arrangement **13*a*, 14*a* respectively as shown in FIG. 1 of the drawings, which seal arrangement is of well known configuration to enable the rams 13 and 14 to sealably engage with a tubular member or a wireline that may extend through the bore 10** of the blowout preventer, or to sealably engage each other to close off the bore when a tubular member is not present therein as illustrated in FIG. 1 of the drawings. The seals 13*a*, 14*a* are configured as represented by the dotted lines to accomplish the foregoing and also to seal the rams in their chambers and to seal off the chambers behind the rams from zone Z.

In FIG. 1 the rods 15, 16 are shown as including a threaded portion 15*a*, 16*a* which engages a suitable threaded portion of the housing represented at 17 and 18 and enable a suitable mechanism to be attached to the rod end which projects out of the housing for rotation of each rod to in turn impart movement to the rams 13, 14 longitudinally of their respective chambers. Each rod 15 and 16 sealably extends through the housing by means of the seals 19 and 20, respectively, which may be of any well known suitable configuration. The seals 19 and 20 are retained in position by means of the retainer ring 21, 22 and the bushings 23, 24 as shown. It can be appreciated that any suitable seal arrangement to accomplish the desired function may be employed.

The foregoing arrangement serves to support the rods 15, 16 for reciprocation along with their respective ram in the chambers in which the rams are positioned.

Figure 4:
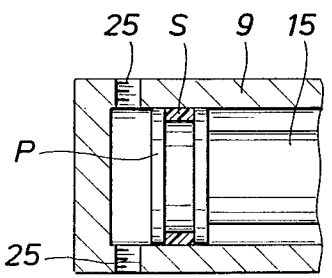
FIG. 4 is a partial view illustrating an alternate arrangement for supporting the rods for reciprocation of the rams in their respective chambers.

FIG. 4 illustrates an alternate means of positioning which includes a piston P which may be integrally formed with each of the rods 15, 16 and a seal S for sealably engaging between each rod and the wall of the housing whereby fluid pressure may be provided through the ports 25 for moving the rods and rams inwardly within the housing to close off the bore 10.

It will be noted that at least one ram, and as illustrated, each ram 13 and 14 is provided with a passage 13*a*', 14*a*' having one passage end 13*b* and 14*b*, respectively, which communicates with the zone Z of the bore 10 above the rams 13, 14 as shown in FIG. 1. The passages 13*a*', 14*a*' have a second passage end 13*c*, 14*c* which communicates with the chambers 11, 12, respectively, and adjacent and in alignment with the ends of the rods 15 and 16 as shown. In the embodiment shown, check valve means referred to generally by the letters CV are provided in the end of each rod 15 and 16 as shown. More specifically the end of each rod and 15 and 16 is provided with a longitudinally extending recess or counterbore 30 and 31, respectively, as shown. Each valve, in the embodiment shown includes a plunger or body 32 that extends longitudinally within its respective rod recess and is provided with a suitable enlargement 32*a* against which one end 33 of the spring 34 rests. The other end 35 of the spring rests against the bottom B of its respective recess as illustrated in the drawings to resiliently support the valve on the rod to accommodate relative movement therebetween. Where the valve means is other than a check valve, other suitable arrangements to accommodate relative longitudinal and lateral movement between the valve means and rod may be employed. A retainer ring 36 abuts one surface of the enlargement 32*a* as shown and a lock ring 37 fitting within groove 38 releasably retains the retainer ring 36 in position. It will be noted that the annular edge surface 33*a* of the enlargement 32*a* is of less radial extent than the diameter of the recess in which it fits to provide an annular gap or clearance G as illustrated in the drawings. Similarly, the diameter or radial extent of the extension 32*a*' projecting from enlargement 32*a* is of a smaller diameter or less radial extent, than the inner diameter of the opening 36*a* through the retainer ring 36 to provide an annular space or clearance. The end of the extension 32*a*' is provided with a suitable configured recess 38 for receiving and securing ball 39 therein against rotation.

Figure 2:
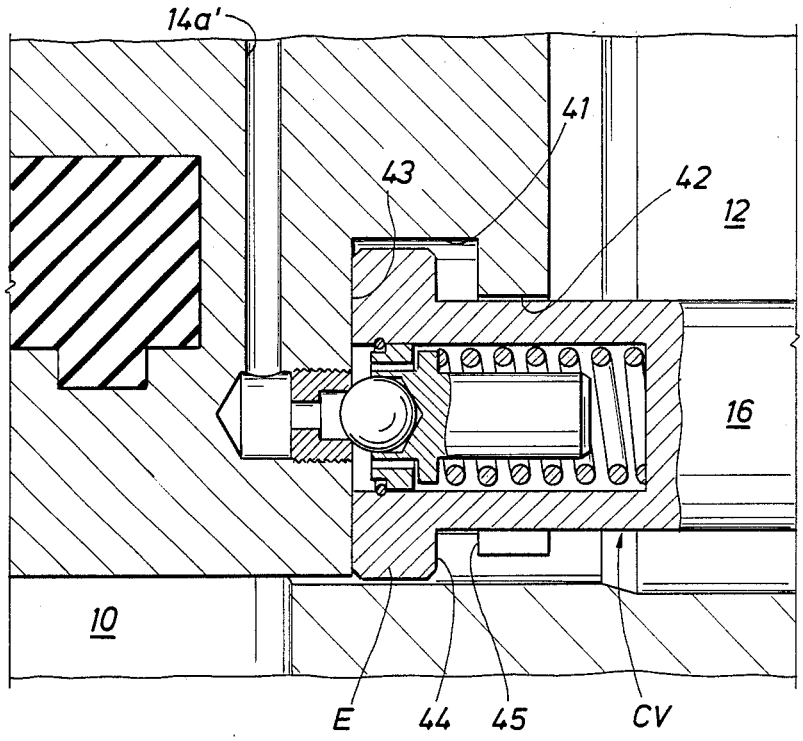
FIG. 2 is an enlarged sectional view illustrating in greater detail a portion of the ram and the chamber in which it is positioned with the rod that is connected to the ram moved to a position so that the check valve in the end of the ram engages the ram passage that terminates within the chamber to close it off.
Figure 3:
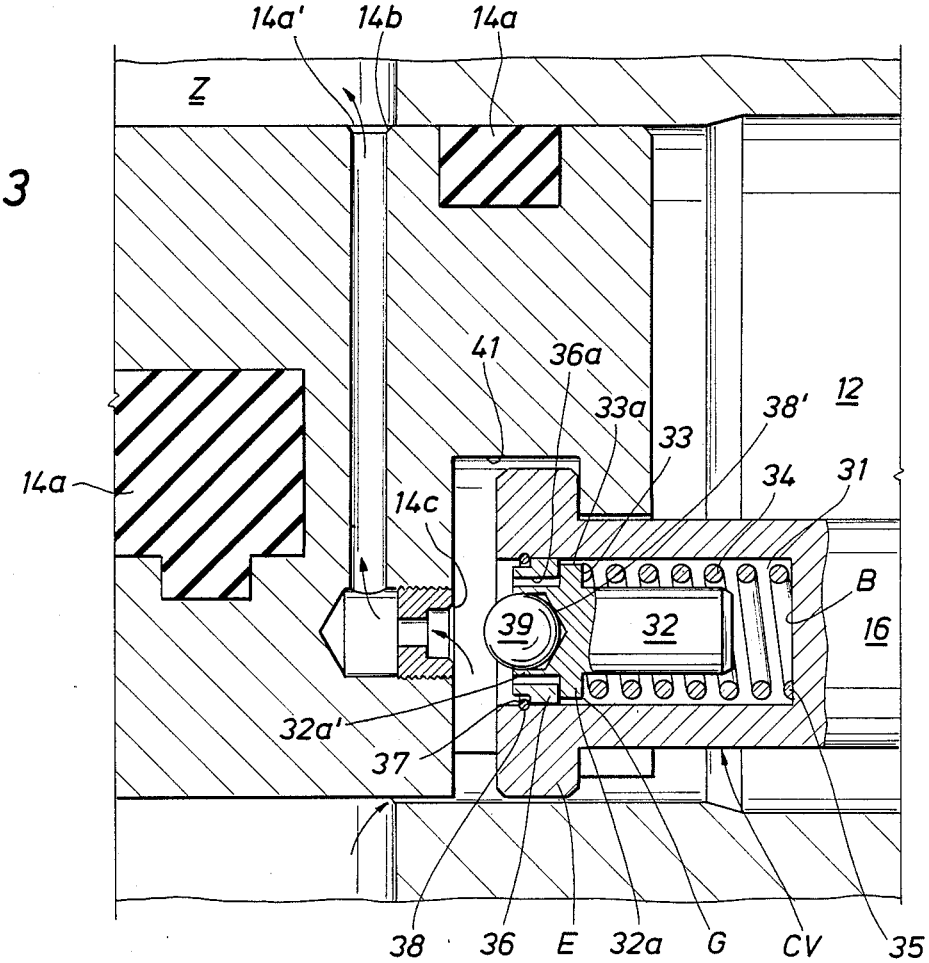
FIG. 3 is a view similar to FIG. 2 but illustrates the position of the rod and ram for communicating the zone beneath the ram with the zone above the ram in the bore to equalize pressure therein.

It will be further noted that there is no seal between the rams 15, 16 and their chambers which are exposed to zone $Z_1$ below the closed rams illustrated in FIGS. 1 and in more detail in FIGS. 2 and 3. This enables the well bore pressure beneath the closed rams to have access to the chambers 11 and 12 at the rear of the ram and exert a force thereagainst to assist in retaining the rams closed. As shown in FIG. 1, when the rams close off the bore, or seal around an object extending in the bore, seals 13*a*, 14*a* prevent communication between zone $Z_1$ and zone Z. When the rams are in closed position with the valve seated thereagainst as shown in FIG. 2, pressure from beneath the ram in zone $Z_1$ may be sufficient so as to cause ram 14 as well as ram 13 to move upwardly or laterally relative to the respective chamber in which each ram is positioned. This lateral movement tends to misalign the second passage end 14*c* with the adjacent member 39 of the check valve, but in the present invention this is overcome because the gap presented between the surface 33*a* and the inner diameter of recess 31 as well as the gap between the opening 36*a* and the outer diameter of the extension 32*a* enables the plunger 32 and associated seating member 39 to move laterally relative to the rod recess 31 and to the rod so as to maintain proper seating alignment with the second passage end 14*c* and thereby maintain it closed off to avoid premature leakage of fluid or undesired leakage of fluid from zone $Z_1$ to zone Z above the rams. The enlargement 32*a* and the retainer ring 36 provides a means to limit the longitudinal movement of the check valve means CV relative to the rod in which it is positioned, and the surface arrangement providing the gap or clearance between the enlargement 32 and the recess 31 and the clearance between the extension 32*a*' and retainer ring provide a means to accommodate lateral movement of the check valve means relative to the rod and ram as above described.

Each rod is connected with its respective ram by reason of the recess 41 which is slotted as illustrated at 42 to enable the rod with the annular enlargement E thereon to be connected with the rear end of each ram and the ram and its rod then inserted in position in the blowout preventer. It will be noted that the extent or width of the recess 41 in the ram is of greater extent than the width of the enlargement E on the rod so that there may be relative longitudinal movement between each rod and its respective ram until the front end of the enlargement E on each rod abuts the surface 43 of recess 41 through which the second passage end 14*c* extends. Similarly, each rod may be withdrawn or moved longitudinally in the chamber relative to the ram until the surface 44 of enlargement E abuts the surface 45 of recess 41 on the ram. This provides a lost motion arrangement to enable each rod to be moved rearwardly relative to its ram as shown in FIG. 2 so that fluid pressure from zone $Z_1$ may flow through the passage 13*a*', 14*a*' of each ram to balance the pressure above and below the rams so that the rams may be more readily opened when desired.

While the invention is illustrated as having a passage through both rams 13, 14, it can be appreciated that it is only necessary to have the passage through at least one ram and it is necessary to have a check valve on only the rod that actuates the ram in the chamber in which the second passage end terminates.

It can be seen from the foregoing description, that the present invention provides a blowout preventer wherein the rods which actuate the rams serve as the guides to avoid rotation of the rams as they are reciprocated within each chamber. This eliminates the undesirable characteristics that may arise by using a key and keyway interconnection between the ram and the chamber wall. Also, by providing a valve means that positively seats and is urged to seating position and which accommodates lateral movement of the rams relative to the valve means while maintaining a seal between the ram and valve means overcomes problems that are encountered with seals of prior devices.

The foregoing disclosure and description of the invention are illustrative and explanatory thereof, and various changes in size, shape and materials as well as in the details of the illustrated construction may be made without departing from the spirit of the invention.

What is claimed is:

1. Apparatus for use with a blowout preventer having a housing with a bore therethrough and longitudinally extending chambers which intersect the bore with rams reciprocable within the chambers between a first position for opening the bore and a second position for closing the bore to divide the bore into zones above and below the rams, said apparatus comprising:

a rod connected to each of the rams and extending longitudinally within each of the chambers and offset relative to the longitudinal axis of the chambers, the connection between said rod and its respective ram including means to accommodate a predetermined amount of free, relative longitudinal movement between said rod and the ram with which it is connected, said means to accommodate including a recess in the ram and an enlargement on the end of the rod for fitting within the recess, the width of said recess being greater than the width of said enlargement whereby said rod when moved longitudinally toward or away from the ram may move said predetermined free amount of lonigtudinal movement before moving the ram inwardly into the bore or before withdrawing the ram outwardly from the bore;

passage means in at least one ram, said passage means having a first passage end for communicating with the zone above the ram and a second passage end communicating with the chamber adjacent the end of said rod connected to the ram;

means for closing off communication from the zone below the ram to the zone above the ram, said means including valve means supported adjacent the end of said rod, said valve means including:

a longitudinally extending recess in the end of said rod;

a plunger telescopically received in said recess in the end of said rod that is connected with the ram;

spring means supporting said plunger for movement relative to said rod;

stop means to limit the movement of said plunger toward the ram;

closure means associated with the plunger for engaging and closing off said second passage end to prevent communication from the zone below the ram to the zone above the ram;

means to accommodate lateral movement of said valve means relative to said rod, said means to accommodate lateral movement including surface means on said plunger smaller in width than the recess in which said plunger is received to accommodate lateral movement of said plunger and closure means thereon relative to said rod; and means for supporting the rods for reciprocation in their respective chambers between the first and second ram positions.

2. The apparatus of claim 1 including passage means in each ram, said passage having a first passage end for communicating with the zone above the ram and a second passage end communicating with the chamber adjacent the end of said rod connected to the ram, and means for closing off communication from the zone below the ram to the zone above the ram, said means including valve means supported adjacent the end of said rod for longitudinal movement therebetween for closing off the passage end that communicates with the chamber adjacent the end of said rod.

3. The apparatus of claim 1 including means to maintain said valve means and said second passage end engaged to prevent communication between the zones upon lateral movement of the ram in the chamber when closing off the bore and wherein said valve means is a one-way acting check valve.

4. Apparatus for use with a blowout preventer having a housing with a bore therethrough and longitudinally extending chambers which intersect the bore with rams reciprocable between a first position for opening the bore and second position for closing the bore to divide it into zones above and below the rams, said apparatus comprising:

a rod connected to each of the rams and extending longitudinally within each of the chambers;

means for supporting each rod for reciprocation within its respective chamber between the first and second ram positions;

passage means in at least one ram, said passage means having a first passage end for communicating with the zone above the ram and a second passage end for communicating with the chamber adjacent the end of said rod connected to the ram;

means for closing off communication from the zone below the ram to the zone above the ram, said means including:

means including one-way acting check valve means associated with said rod for closing off the second passage end that communicates with the chamber adjacent the end of said rod; and means to maintain said valve means and said second passage end engaged to prevent communication between the zones upon movement of the rams in the chamber when closing off the bore; said valve means including:

a longitudinally extending recess in the end of said rod; a plunger telescopically received in said recess in the end of said rod that is connected with the ram;

spring means supporting said plunger for movement relative to said rod;

stop means to limit the movement of said plunger toward the ram;

closure means associated with the plunger for engaging and closing off said second passage end to prevent communication from the zone below the ram to the zone above the ram; and means to maintain said closure means and said second passage end engaged to prevent communication between the zones upon predetermined movement of the ram in the chamber when closing off the bore.

5. Apparatus for use with a blowout preventer having a housing with a bore therethrough and longitudinally extending chambers which intersect the bore with rams reciprocable between a first position for opening the bore and second position for closing the bore to divide it into zones above and below the rams, said apparatus comprising:

a rod connected to each of the rams and extending longitudinally within each of the chambers and offset relative to the longitudinal axis of the chambers;

means for supporting each rod for reciprocation within its respective chamber between the first and second ram positions;

passage means in at least one ram, said passage means having a first passage end for communicating with the zone above the ram and a second passage end for communicating with the chamber adjacent the end of said rod connected to the ram;

means for closing off communication from the zone below the ram to the zone above the ram, said means including:

means including one-way acting check valve means supported adjacent the end of said rod for closing off the second passage end that communicates with the chamber adjacent the end of said rod, said valve means including:

a longitudinally extending recess in the end of said rod; a plunger telescopically received in said recess in the end of each rod;

spring means supporting said plunger for movement relative to said rod;

stop means to limit the movement of said plunger toward the ram;

closure means associated with the plunger for engaging and closing off said second passage end; and means to maintain said valve means and said second passage end engaged to prevent communication between the zones upon movement of the ram in the chamber when closing off the bore; and means to maintain said closure means and said second passage end engaged to prevent communication between the zones upon lateral movement of the rams in the chamber when closing off the bore, said means to maintain including surface means on said plunger smaller in width that the recess in which said plunger is received to accommodate lateral movement of said plunger and closure means thereon relative to said rod.

* * * * *